United States Patent [19]

Rousseau et al.

[11] Patent Number: 4,637,803

[45] Date of Patent: Jan. 20, 1987

[54] PROCESS FOR POSITIONING AND GRASPING SEMI FERRITES FOR A MAGNETIC CORE AND CENTERING DEVICE FOR OPERATING SAID PROCESS

[75] Inventors: Jean Rousseau, Genlis; Jean P. Fourche, Marsaunay la Cote, both of France

[73] Assignee: Videocolor, Montrouge, France

[21] Appl. No.: 702,602

[22] Filed: Feb. 19, 1985

[30] Foreign Application Priority Data

Feb. 21, 1984 [FR] France ..... 84 02570

[51] Int. Cl.[4] ..... H01J 9/236

[52] U.S. Cl. ..... 445/23; 29/606

[58] Field of Search ..... 445/23, 36; 29/606, 29/607, 423

[56] References Cited

U.S. PATENT DOCUMENTS 1,889,398 11/1932 Bishop ..... 29/606

3,799,462 3/1974 Fahrbach ..... 242/4 C

FOREIGN PATENT DOCUMENTS 2351903 1/1977 France .

57-13648 1/1982 Japan .

OTHER PUBLICATIONS

Patents Abstracts of Japan, vol. 6, No. 72 (E-105) [950], 7 mai, 1982.

*Primary Examiner*—Kenneth J. Ramsey

*Attorney, Agent, or Firm*—Oblon, Fisher, Spivak, McClelland & Maier

[57] ABSTRACT

The present invention concerns a process for the centering of position and grasping of semi ferrites and the invention also proposes a centering device that comprises a table, the tray of which carries centering elements of the semi ferrite applied on the tray by V-shaped forms and a movable clip for grasping the semi ferrite once it has been centered, wherein the clip thus acts to memorize the position of the magnetic axis of the semi ferrite, especially for winding operations with a view to the manufacture of a television tube deflector.

16 Claims, 7 Drawing Figures

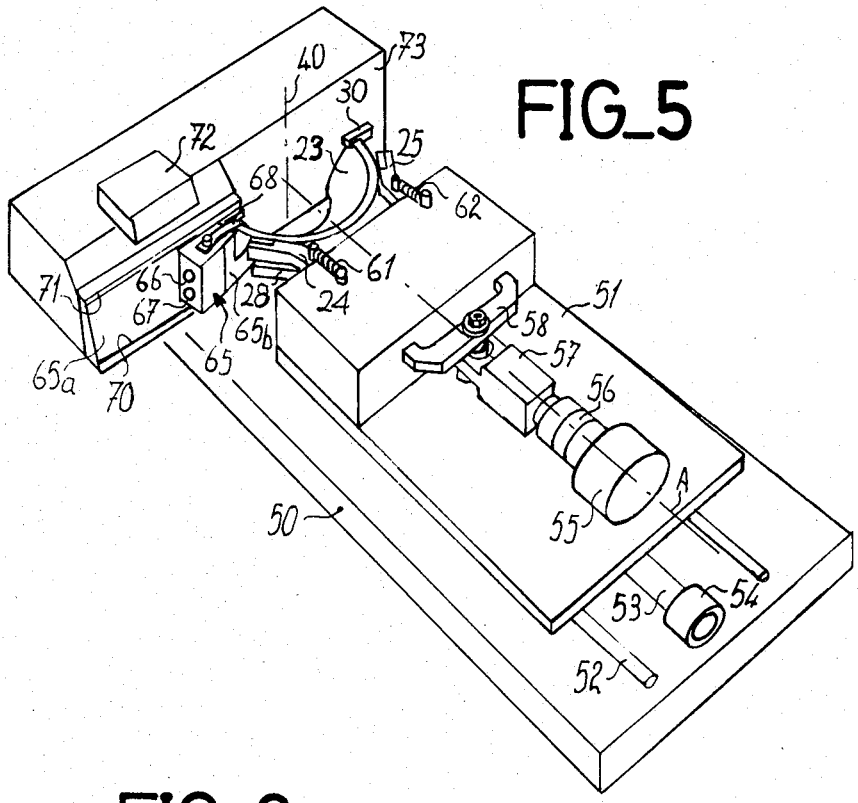
FIG_5
FIG_6
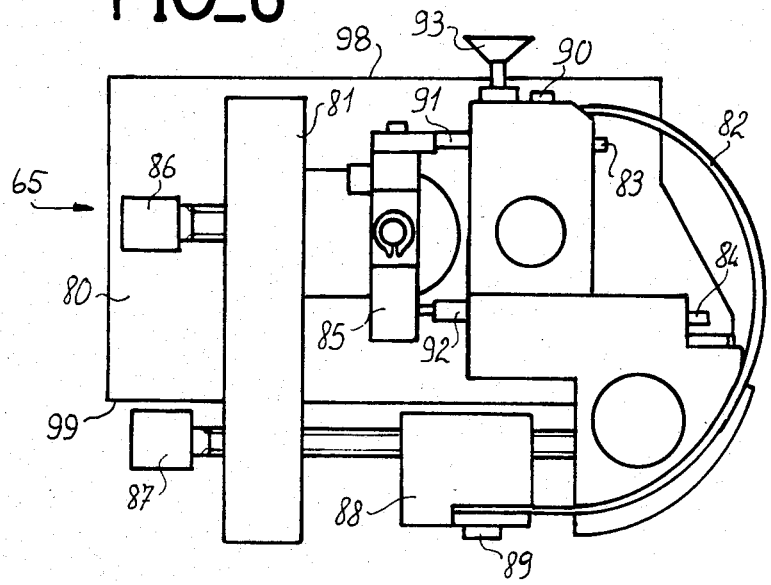

PROCESS FOR POSITIONING AND GRASPING SEMI FERRITES FOR A MAGNETIC CORE AND CENTERING DEVICE FOR OPERATING SAID PROCESS

BACKGROUND OF THE INVENTION

The present invention concerns a process for the positioning and grasping of a semi ferrite for a magnetic body or core, especially for a cathode tube deflector. It also concerns a centering device for applying the process according to said invention. The present invention can especially be applied in the field of manufacturing colour television tubes.

According to such known devices, the image is obtained through electronic deflection achieved by a magnetic deflector. Standard magnetic deflectors comprise two windings, the fields of which are orthogonal in order to create respectively the line scanning and the raster scanning. The deflector comprises a magnetic core in order to strengthen the magnetic field in the deflection zone. In certain deflector construction processes, one of the windings has a toric form and is constituted by a stacking of turns mounted upon the magnetic core. According to one particular embodiment of the prior art, the toric winding is realized in two halves on two semi ferrites which, once they are assembled securely together constitute the wound magnetic core. According to such processes, the magnetic core is constituted by a ferrite that has been initially fractured along a split plane that has relatively little geometric determination. Thereafter, each semi ferrite is wound and the two semi ferrites issuing from a single ferrite are connected to each other and secured by means of spring-form metallic pieces. It is obvious that the magnetic axis of the core must be known as precisely as possible in order to achieve an appropriate winding.

DESCRIPTION OF THE PRIOR ART

Various winding methods are known according to the prior art, especially that disclosed in French patent application published under No. 2 351 903. According to this prior art, each demi ferrite is grasped by the fractured or split edge and then wound according to a process that is not in connection with the present invention. The surfaces in contact with the grasping element are machined or tooled with precision in order to allow accurate reference positioning or marking of the magnetic axis. However, this type of process has several drawbacks. Firstly, it requires lengthy and expensive operations in order to allow machining of large surface areas. Thereafter, machining of the broken edge of the semi ferrite no longer allows to conveniently close the magnetic circuit once the two semi ferrites have been assembled together. According to another embodiment of the prior art, in particular that disclosed in European Patent application No. 509 003, the magnetic core comprises on either side of the break plane precisely machined grooves that allow a well positioned grasping of the ferrite so as to achieve accurate windings. Since the grooves are provided along the length of the ferrite, these operations are relatively complex and in particular weaken the ferrite. Furthermore, there is relatively considerable removal of material, thereby modifying the geometry of the field lines.

It will be understood that the complexity of the problem arises from the precision sought, which is about one tenth of a millimeter, and from the relative imprecision of the ferrite obtained by powder sintering. The baking which confers on the ferrite its definitive magnetic properties provokes shrinking by 20 to 30% of the initial dimensions. This means that a large number of geometric defects exist once the ferrite has been manufactured. Furthermore, the break plane must be a symmetry plane and the broken surfaces are not and must not be geometrically flat in order to achieve their exact reassembly. Another type of solution according to the prior art consists in retrieving the magnetic axis of the ferrite by means of a particular assembly. The ferrite is mounted upon a succession of frustums of cones internally at a tangent to its surface and this centering is transferred onto plastic pieces positioned on this assembly and glued at this stage on either side of the ferrite. Thereafter, the plastic pieces act as reference marks for the winding and deflector adjustment operations. They also act as prehension means for the clips for any handling of the ferrites. This type of solution is relatively expensive and, furthermore, leads to results that are dependent upon the care with which the gluing operations of the plastic pieces are carried out.

According to another type of solution, the ferrite bears upon its annular edges small-sized recesses that will act as position reference marks for positioning the plastic pieces. The precision of the positioning operation depends upon the external bearing diameter of the ferrite, known assemblies being comprised of a fixed abutment upon which rests the recess, of a semi circular bearing area upon which bears an external diameter of the ferrite and of a moveable abutment resting upon the opposite recess of the ferrite. Such solutions require a preliminary sorting of the ferrites into homogeneous classes of precision and, furthermore, do not allow automatizing the deflector manufacturing lines. The object of the present invention is to allow the restitution of the axis of the ferrite as a function of its geometrical characteristics, while avoiding the necessity of sorting the ferrites into different classes and allowing automatization of the manufacturing process.

SUMMARY OF THE INVENTION

Indeed, the present invention concerns a process for positioning and grasping a semi ferrite for a magnetic core, especially for a cathode tube deflector. The semi ferrite comprises on the flanks of its break plane reference elements for the position of its magnetic axis. The essential feature of the process is that the ferrite is, firstly, applied on a positing table bearing upon centering elements. Then, the ferrite is grasped by a clip in such a position that the clip retains the position data of the magnetic axis, independently from the table and from the reference elements of the semi ferrite.

The present invention also concerns a centering device operating the process according to said invention. Such a centering device comprises:

- a table comprising a tray which contains the direction of the magnetic axis of the semi ferrite and centering means;
- a removable clip on the table which bears means for grasping the semi-ferrite once it has been positioned on the centering device tray.

BRIEF DESCRIPTION OF THE DRAWING

Other advantages, objects and features of the present invention will be better understood by reading the following description given with reference to the drawings in which:

FIG. 5 represents a diagram of the centering device according to the invention;

FIG. 6 represents a diagram of a clip according to one particular embodiment of the invention;

DESCRIPTION OF THE PREFERRED EMBODIMENTS

Figure 1:
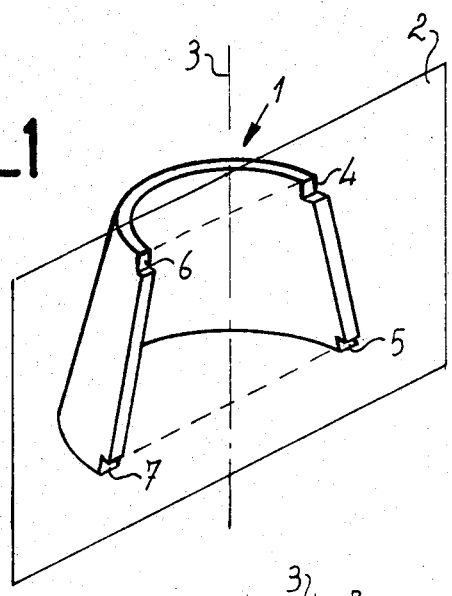
FIG. 1 represents a semi ferrite utilized in the process according to the invention.

FIG. 1 represents a semi ferrite. The general form of the ferrite is a frustum of cone. The ferrite therefore comprises two end edges, an upper edge constituted by a small circular crown, the other lower edge constituted by a large circular crown. The ferrite is obtained by moulding and sintering any suitable magnetic material. According to one known process for manufacturing a deflector, a coil having toric turns is fitted upon the ferrite. A first method consists, by utilizing special mechanical means, in winding the wire with a shuttle that moves around the flanks of the ferrite outside and inside it. The invention concerns another type of manufacture according to a second method. The ferrite is previously broken into two substantially equal halves. Each semi ferrite is wound upon a special machine, then the two wound semi ferrites are again put into a pair and assembled together so as to constitute a toric winding on the ferrite. The winding must be achieved along a known magnetic axis that depends, in particular, upon the geometry of the ferrite. Therefore, the semi ferrite must be placed on the winder so that the position of the magnetic axis is appropriate. It is therefore necessary that each semi ferrite memorizes the position of the magnetic axis of the ferrite. Since the ferrite is a body generated by revolution, it is possible to select the central axis of the ferrite as the magnetic axis of the wound ferrite in any plane passing through the diameters of the upper and lower edges of the frustum of cone-shaped ferrite. In order to share the ferrite into two parts, a plane called a break plane is selected by providing starting points of rupture at the intersection of the edges of the ferrite and of the future break plane. The geometric marking of these starting points of rupture allows to memorize the position data of the central axis of the ferrite. In practice, the incipient rupture points are obtained through recess moulding during manufacture of the ferrite.

FIG. 1 represents a semi ferrite 1, the central axis 3 of which is in break or fracture plane 2. It will be noted that the position of this axis 3 is half-way between recesses 4 and 6 of the semi circle constituting the upper edge and recesses 5 and 7 of the upper edge.

The semi ferrite thus bears position data as to central axis 3. The split or fractured edges which are represented smooth in rupture plane 3, are in fact fairly irregular surfaces since they issue from the fracture of a sintered material. This feature will require that the semi ferrites originating from a single split ferrite be put back together in order that the irregularities of the fractured edges correspond. The present invention also allows to mainly overcome the ovalization defects of these edges of which the known processes of alignment or grasping.

Figure 2:
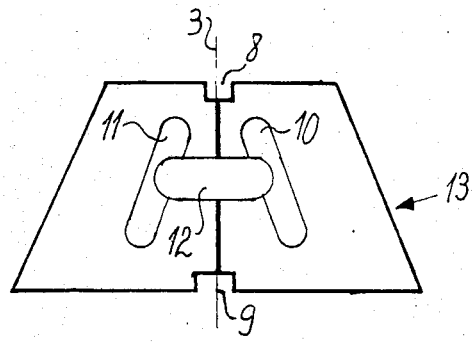
FIGS. 2 and 3 represent ferrites according to the prior art.

FIG. 2 represents a magnetic core or ferrite 13 constituted by two semi ferrites with recesses 8 and 9. Magnetic axis 3 belongs to the rupture plane separating the two semi ferrites. Each semi ferrite comprises a recess 10 or 11 provided in the conical body of the ferrite. The assembly of the two semi ferrites is secured by a removable piece 12 made of steel for a spring, housed within recesses 10, 11 on each fractured side of the reconstituted ferrite.

Other position reference marking elements of the semi ferrite are provided by replacing the recesses. These elements comprise lugs disposed on either side of the fractured edges of the semi ferrite towards the inside or the outside of the concavity of the semi ferrite, according to the case. The dimensions of these lugs are determined according to the grasping elements utilized in the process according to the invention, in order to allow well positioned grasping of the semi ferrite.

Figure 3:
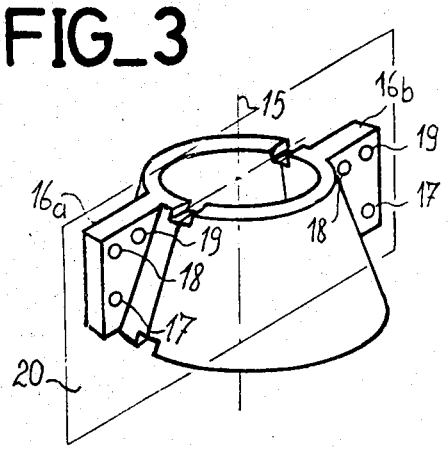

FIG. 3 represents a whole ferrite assembled with ears. This figure illustrates an embodiment of the prior art. Each ferrite is provided with geometric reference and grasping ears that are glued on its flanks. Fracture plane 20 of ferrite 14 is parallel to the planes in which are located two ears 16*a* and 16*b*. An ear 16*a* or *b* comprises three holes 17-19 which allow to determine with accuracy the position of central axis 15 and a future attachment of the semi ferrite to a winder. The ear is made of a plastic material which is glued onto the ferrite.

Figure 4:
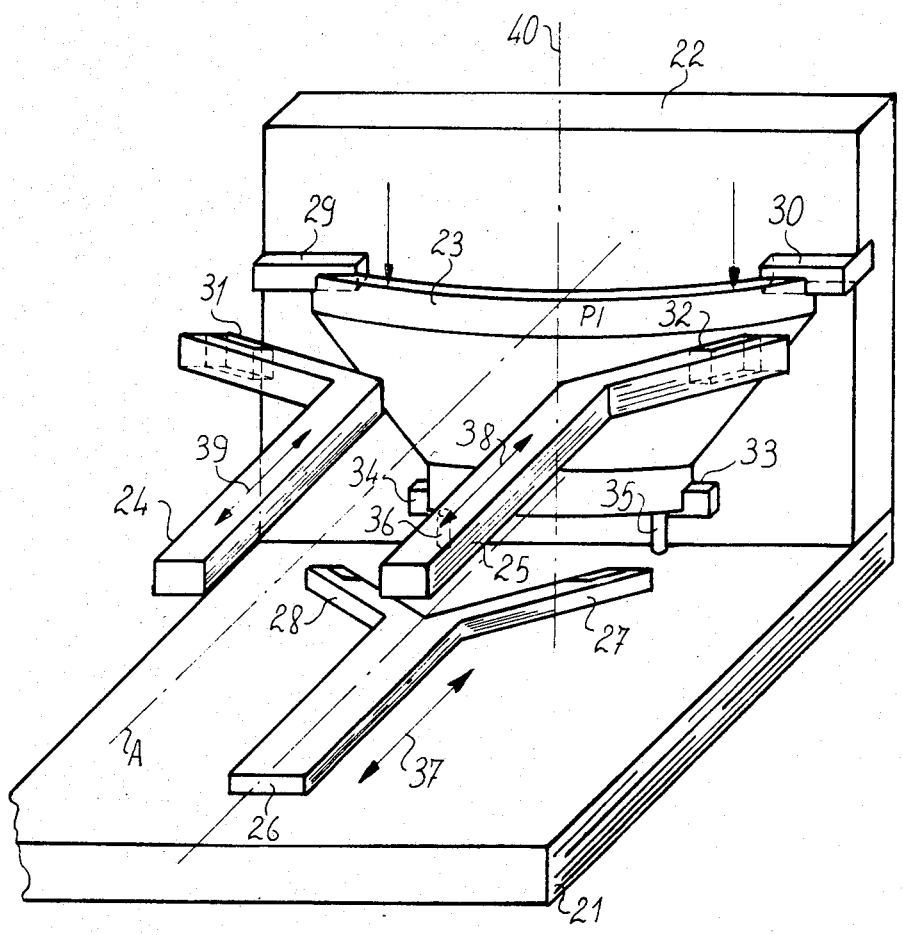
FIG. 4 represents a schematic explanatory diagram of the process according to the invention.

FIG. 4 represents a schematic of centering device according to the invention which will allow for the description of the process according to the invention. In a schematic form, the centering device comprises a table 21, 22 constituted by the table 22 per se and a base plate 21. Table 22 comprises a flat vertical face on which are disposed centering elements 29, 30, 33–36. These centering elements are mainly protruding parts or ribs 29 and 30 intended to rest in the upper recesses of semi ferrite 23 placed in the centering device. It also comprises ribs 33, 34 which rest in the lower recesses of semi ferrite 23. Furthermore, they comprise needles 35 and 36 that ensure the positioning along axis 40 of semi ferrite 23. It will be observed that to the rear of the assembly are provided a lower V-shaped member 27, 28 bar and upper double semi-V-shaped member 24, 25. In the process according to the invention, bar 26 which actuates V-member 27, 28 carries out a centering along a first reference axis of semi ferrite 23 on the desired axis 40. V-member 26, 27, 28 is movable along direction 37. Ends 27 and 28 of this lower V-member bear on the edges of the lower circular crown of semi ferrite 23. Then, in a second movement, the two upper half V-members 24 and 25 are translated along directions 38 and 39 so as to apply their ends 31 and 32 on the upper crown of semi ferrite 23. This latter movement allows to apply correctly the semi ferrite on table 22, the bearing on needles 35, 36 occurring through gravity. Semi ferrite 23 rests on needles 35 and 36 so as to suitably adjust its height with respect to base plate 21. In this position, the ferrite is centered on axis 40 which means that its magnetic axis coincides with axis 40 traced on table 22.

In this schematic representation, it is necessary to bring a prehension element or clip, which allows to grasp semi ferrite 23 in a position that transfers the data of position of the axis 40 on a geometric element of the grasping clip disposed at 90° with the fracture plane, for example, between the V-members of the centering device. The geometric element that acts to memorize the position data of magnetic axis 40 of the semi ferrite is constituted by two parallel edges, 98 and 99, of a plate constituting the body of the clip. The geometric memorization element can also be constituted by three bores of the clip body the positions of which relative to the centering elements of the table of the centering device are known. This grasping operation is the second main phase of the process according to the invention. The clip is removable. In a first embodiment according to the invention, the clip grasps semi ferrite 23 along axis A. This clip, positioned between upper semi V-members 24 and 25 grasps the ferrite along a plane perpendicular to the vertical reference plane of table 22. Mechanical guiding members (not represented in FIG. 4) are provided so that this grasping plane perpendicular to plane 22 also contains centering axis 40. It is therefore necessary that grasping clip (not represented) comprises a mechanical reference element that contains both axis A and axis 40. This can be carried out by utilizing a tray at least one face of which contains the plane created by axes A and 40.

FIG. 5 represents a detail showing of a particular embodiment of a centering device according to the invention. Such a centering device and clip assembly is particularly adapted to the invention. The centering device comprises essentially a base plate 50 and a table 73. Base plate 50 carries a trolley 51, translationally movable along two tracks 52 through the intermediary of an endless screw 53 movably driven by a motor 54.

The trolley carries motor elements of semi V-members represented in FIG. 4 described-herein-above. This drawing represents upper semi V-members 24 and 25 that are urged on axis A by springs 61 and 62. Part 28 of lower V-member of the centering device is also shown. In this embodiment, semi ferrite 23 is grasped by its left edge by a clip 65. In this particular embodiment, table 73 bears centering elements on the side of the not grasped edge of the ferrite. Centering element 30 assists with the centering by penetrating in the corresponding recess of the edge of the semi ferrite. These centering elements are completed by a lower rib and a needle which thus forms the triplet already described in FIG. 4. On the opposite face of the semi ferrite is disposed a clip 65 essentially constituted by a tray 65*a* disposed between two slides 70, 71. The clip comprises a positioning and grasping portion 65*b*.

In FIG. 5, clip 65 has been represented schematically. Locking member 72 of the clip allows to maintain the clip in position on the table. In the process according to the invention, the clip is first of all disposed by its tray 65*a* in slides 70, 71 that act as support means for the clip on its centering device. Trolley 51 is in its retracted position. Thereafter, manually or by an automatic distribution system (not represented) semi ferrite 23 is introduced in the zone of axes A and 40. Then, trolley 51 is caused to advance by screw 53 and motor 54 along axis A until a fixed abutment. In a second phase, a motor 55 actuates core engagement surfaces of the members 27, 24 and 25 by means of a rocking calliper 58, 57. Rocking calliper 57, 58 is mounted pivotally around a horizontal axis perpendicular to advancing direction A, so as to distribute the thrust between upper and lower V-members. It bears a fork 58 that rocks along an axis close to vertical and balances the thrust between the two upper semi V-members. Once the travel distance has been achieved, motors 54 and 55 provided with couple limiters such as limiter 56 maintain a pressure on semi ferrite 23, positioning of the ferrite on the table is achieved at this moment. The clip is put into service. It comprises three positioning elements which, according to a preferred embodiment, includes two centering lugs 83, 84 visible in FIG. 6. These pieces are movable along a direction perpendicular to the central alignment axis 40 and close to the fracture plane. The clip also bears grasping means 68 that allow to maintain the semi ferrite on the clip when it is activated by means 67 . This activation is carried out after the semi ferrite has been positioned on the clip table assembly. Activation means 67 of grasping means 68 is manual. It is either available to an operator by means of a screw-driver if the grasping means are mechanical or by means of a switch if the grasping means are electrical such as an electro magnet or can be actuated by an external automatism (not represented in FIG. 5).

The centering elements are activated by mechanical control means 66, an embodiment of which is described herein-below. Means 66 can also be actuated by an operator or external automatism or centering device of the invention. Once the centering and attachment has been carried out, trolley 51 is withdrawn. Locking device 72 is disactivated and manual or automatic handling means can remove clip 65 from tracks 70, 71.

FIG. 6 represents a particular embodiment of a clip adapted to the invention. Such a clip comprises a tray 80 upon which is mounted a support 81 of activation screws 86 and 87 of the grasping and centering elements. Tray 80 acts, once the semi ferrite has been centered and grasped according to the process, to transport anywhere the position data of the central axis of the semi ferrite thus grasped. Upon the tray is attached a band 82 constituted by a metal strip secured, on the one hand, by a screw 90 in the upper portion of the tray and on the other hand, to a lower portion by a screw 89 on a trolley 88 movable on screw 87. When screw 87 is maneuvered, trolley 88 advances or moves back according to the rotation direction of the screw. It will thus be understood that a force can be applied to band or strip 82.

The clip also comprises lugs 83 and 84 movable in translation along a horizontal axis according to the drawing, i.e. an axis parallel to the axis of screws 87 and 86. These lugs are intended to bear on the external face of the semi ferrite installed on tray 80 so that the tightening of band 82 allows firm application of the external face of the semi ferrite on centering pieces 83, 84.

It is apparent from the preceding description that the tightening of band 82 only intervenes after screw 86 has allowed maneuvering of lugs 83 and 84 that complete the effect of the centering elements disposed on the table of FIG. 5. Indeed, once screw 86 has been maneuvered, by calliper 85, to balance a centering effort through the intermediary of rods 91 and 92 on lugs 83 and 84 as described hereinabove for rocking calliper 57, 58 of FIG. 5. A push-button 93 allows to block the adjustment independently of the withdrawal of the rotation couple applied to screw 86 by automatic screwdriver. The automatic screwdriver that maneuvers screw 87 thus allows tightening of band 82 as described herein-above. The clip bearing the semi ferrite can also be used for different purposes, especially the winding of the semi ferrite. The position of the magnetic axis of the semi ferrite is known with precision in function especially of the plane in which tray 80 is located.

Other embodiments of clips are utilized. In particular, a clip of this type is not easily adapted for grasping the semi ferrite other than on an edge of the fracture plane. In order to grasp the semi ferrite by its periphery according to the process of the invention, the clip comprises means for magnetizing the ferrite so as to allow a removable controllable attachment of the semi ferrite on the clip. The clip comprises an electro magnet that exercises an attachment force of the semi ferrite on its clip. The centering device comprises centering means for the two edges of the semi ferrite.

Figure 7:
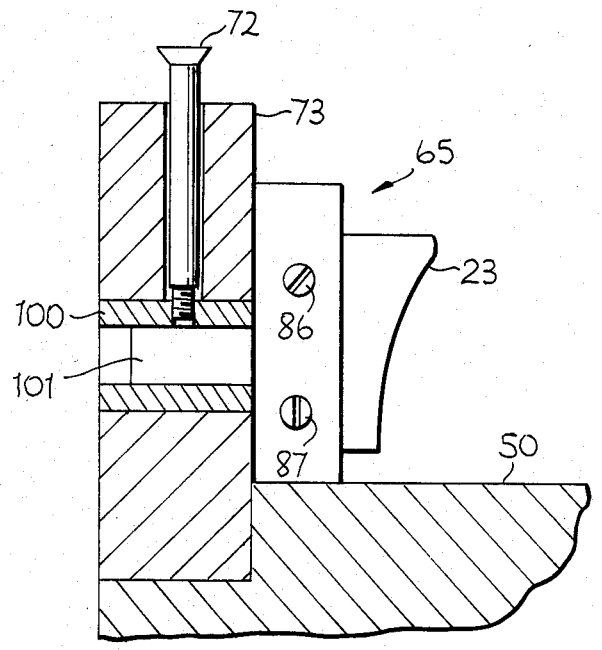
FIG. 7 represents a diagram of a clipped-centering arrangement according to another embodiment of the invention.

Other embodiments of the clip-centering device relation than slides 70, 71 are foreseen. In particular, as shown in FIG. 7 the clip can be borne by the centering device through the intermediary of a shaft 101 introduced by a bore of the table at a vertical plane containing centering axis 40. This shaft 101, integral with table 73 perpendicularly to its plan is taken in by movable attachment means 100 so as to render the clip temporarily integral with the centering device per se during centering and grasping operations. Locking device 72 of the clip on the table thus acts on these attachment means and is controlled as described herein-below in functioning of the process according to the invention.

We claim:

1. Process for positioning and grasping a semi ferrite for a magnetic core, especially for a cathode tube deflector, the semi ferrite comprising on its edges, created by the fracture plane, position reference elements of its magnetic axis, comprising the steps of: applying said semi ferrite on a positioning table; resting said semi ferrite on centering elements in relation to the said reference elements of the semi ferrite; grasping said semi ferrite by a clip in a position such that the clip allows the retention of data as to the position of the magnetic axis, independently of the table and of the centering elements of the table.

2. Process according to claim 1, including the steps of: aligning the magnetic axis on a first axis of reference relative to the table; and transferring this alignment onto the clip.

3. Process according to claim 1, wherein the positioning of the semi ferrite on the centering elements is carried out in two phases:

the portion of the edges corresponding to the small edge of the ferrite is first applied on its centering elements;

then, the portion of the edges corresponding to the large edge of the ferrite is thereafter applied on its centering elements.

4. Centering device for positioning and grasping a semi ferrite for a magnetic core, the semi ferrite comprising on its edges, created by the fracture plane, position reference elements of its magnetic axis, wherein the semi ferrite is applied on a positioning table and wherein said semi ferrite rests on centering elements in relation to said reference elements of the semi ferrite and wherein said semi ferrite is grasped in a position which allows the retention of the data as to the position of the magnetic axis, independently of said table and of the centering elements of said table, said device comprising;

said table comprising a tray providing position reference and a carrier of said centering means of said semi ferrite;

said centering device including a removable clip which bears a grasping means of said semi ferrite once said semi ferrite has been positioned on said tray.

5. Centering device according to claim 4, wherein it comprises a base plate of the tray that bears motor means of the means utilized to apply the semi ferrite on the table.

6. Centering device according to claim 5, wherein the said means to apply the semi ferrite comprise two pushing members, the first constituted by a V shaped member intended to rest on the large crown of the semi ferrite and the second constituted by a second V shaped member, intended to rest on the small crown of the semi crown.

7. Centering device according to claim 6, wherein the table is disposed vertically and the semi ferrite is disposed so that its half-crown of small diameter is below the half-crown of large diameter in order to utilize the gravity load of the semi ferrite during the centering operation.

8. Centering device according to claim 4, the semi ferrite comprising as reference elements of the position of its magnetic axis recesses provided on the corners of the broken edges, wherein the centering elements comprise ribs intended to penetrate within the corresponding recesses of the semi ferrite.

9. Centering device according to claim 7 or 8, wherein the centering elements also comprise needles disposed for bearing vertically under the low crown in order to adjust the height centering, relative to the centering elements of the table.

10. Centering device according to claim 4, wherein the clip comprises:

a position reference element intended to memorize position data of the magnetic axis of the centered semi ferrite;

centering and grasping means ofthe semi ferrite in order to carry the clip in centering position and means for locking the clip in this position during centering and grasping operations of the semi ferrite.

11. Centering device according to claim 10, wherein the clip comprises, in order to realize grasping the semi ferrite by one of its edges, centering elements disposed on said tray acting as position reference portion for the semi ferrite, the clip being carried by the centering device on support means during the centering and grasping operations of the ferrite and being locked there by locking means.

12. Centering device according to claim 11, wherein the said support means comprise two slides in which the clip is introduced laterally on the centering device.

13. Centering device according to claim 11, wherein the said support means comprise a bore disposed on the side of the table of the centering device and an axis integral with the tray of the clip and perpendicular to the reference plane of the said tray, intended to be placed in the bore of the centering device during the centering and grasping operations.

14. Centering device according to claim 11, wherein the centering elements disposed on the clip comprise lugs, intended to rest on the grasped edge of the semi ferrite that is grasped by the clip.

15. Centering device according to claim 10, wherein the grasping means of the semi ferrite comprises a band attached to one of its ends and able to receive a traction on the other end mounted on a trolley.

16. Centering device according to claim 10, wherein the centering and grasping means are activated by activating means.

* * * * *